US006707884B1

(12) United States Patent
Ogawa

(10) Patent No.: US 6,707,884 B1
(45) Date of Patent: Mar. 16, 2004

(54) X-RAY SCATTER REDUCING GRID AND FABRICATION METHOD THEREOF

(75) Inventor: Eiji Ogawa, Kaisei-machi (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/531,218

(22) Filed: Mar. 20, 2000

(30) Foreign Application Priority Data

Mar. 19, 1999 (JP) ..... 11/076038
Feb. 1, 2000 (JP) ..... 2000/024048

(51) Int. Cl.[7] ..... G21K 1/00
(52) U.S. Cl. ..... 378/154
(58) Field of Search ..... 378/154, 147, 378/149, 155; 250/505.1, 363.1

(56) References Cited

U.S. PATENT DOCUMENTS 2,605,427 A * 7/1952 Delhumeau ..... 378/154
4,340,818 A * 7/1982 Barnes ..... 378/155
4,706,269 A * 11/1987 Reina et al. ..... 378/154
5,099,134 A * 3/1992 Hase et al. ..... 250/505.1
5,949,850 A * 9/1999 Tang ..... 378/154
6,055,296 A * 4/2000 Ferlic et al. ..... 378/154
6,175,615 B1 * 1/2001 Guru et al. ..... 378/149
6,181,767 B1 * 1/2001 Harootian ..... 378/19

FOREIGN PATENT DOCUMENTS

JP 10-5207 1/1998 ..... A61B/6/03
JP 10-005207 * 1/1998 ..... A61B/6/03

* cited by examiner

*Primary Examiner*—Edward J. Glick
*Assistant Examiner*—Chih-Cheng Glen Kao
(74) *Attorney, Agent, or Firm*—Sughrue Mion, PLLC

(57) ABSTRACT

A plurality of slots, which incline in directions that focus toward a source of radiation, are formed in plates constructed of a radiation-absorbing substance. Similarly, a plurality of slots, which incline in directions that focus toward the radiation source, are formed in support members constructed of a radiation-absorbing substance. If the support members and the plates are combined by the engagement between the slots, a scatter-ray removing grid in the form of a lattice is constructed such that each support member and each plate incline toward the radiation source.

10 Claims, 11 Drawing Sheets

X-RAY SCATTER REDUCING GRID AND FABRICATION METHOD THEREOF

BACKGROUND OF THE INVENTION

1. Field of the Invention

The present invention relates to an X-ray scatter reducing grid and a fabrication method thereof which are used in an apparatus for X-ray imaging.

2. Description of the Related Art

In the radiation-transmitted image of a subject (such as human body or the like) by radiation transmitted through the subject, it is known that an X-ray scatter reducing grid, for absorbing rays scattered when radiation is transmitted through the subject, is employed in order to obtain a high quality transmitted image in which scattered radiations are reduced.

For the general configuration of the above-mentioned X-ray scatter reducing grid, radiation-absorbing portions and radiation-transmitting portions, which have width in the direction in which radiation travels, are alternately disposed in parallel and are formed into the shape of a flat plate as a whole. When radiation is transmitted through the subject, the scattered radiation travel obliquely and are absorbed and reduced by the radiation-absorbing portions, and only the primary radiation are transmitted through the subject and travel substantially linearly. The primary radiation, transmitted through the radiation-transmitting portions, reach a detector and form a radiation-transmitted image. The radiation-transmitting portions are formed from wood, aluminum or the like, while the radiation-absorbing portions are formed from lead or the like. These portions are alternately and closely disposed and maintain structural strength as a whole. It is desirable that the radiation-transmitting portions have a high transmittance so as not to reduce the transmission of the primary radiation.

As an example of an X-ray scatter reducing grid with its radiation-transmitting portion being air (i.e., a so-called air grid), an X-ray scatter reducing grid disclosed in Japanese Unexamined Patent Publication No. 10(1998)-5207 is known. This X-ray scatter reducing grid is provided with two support members 202*a*, 202*b* curved in the form of a circular arc with respect to focal point F, as shown by reference numeral 200 in FIG. 17. A plurality of paired grooves 204, 206 extending along a Z-axis are formed in the inner surfaces of the support members 202*a*, 202*b* and are directed toward the focal point F (radiation source). Collimator plates 210, which are composed of metal such as tungsten whose radiation (X-rays) absorption is great, are inserted in the paired grooves 204, 206 along the Z-axis through the upper ends of the support members 202*a*, 202*b* and are fixed between the support members 202*a*, 202*b*, as shown in FIG. 17A.

When fabricating the X-ray scatter reducing grid 200 which supports strips (collimator plates 210) as radiation-absorbing members between the two support members 202*a* and 202*b*, the support grooves 204, 206 are first formed at predetermined intervals in the two support members 202*a*, 202*b*. Then, the two support members 202*a*, 202*b* are fixed with a constant space to form the frame of the X-ray scatter reducing grid 200. Next, the collimator plates 210 are inserted in the grooves 204, 206 through the end of the grid frame.

However, because of deflection in the support members 202*a*, 202*b*, deflection in the collimator plate 200, friction between the collimator plate 210 and the grooves 204, 206 developed in inserting the collimator plate 210, etc., the aforementioned method has the disadvantage that the collimator plates 210 are easily bent when they are being inserted over a long distance and the number of fabrication steps is increased. If the width of the grooves 204, 206 is widened to make insertion easy, play will occur between the collimator plate 210 and the groove 204 (or 206) and therefore accurate positioning will become difficult. As a result, focusing accuracy of the collimator plates 210 is reduced. Also, if another set of collimator plates extending in a direction perpendicular to the collimator plates 210 are used to make a cross grid, as shown at 12 in FIG. 1 of the aforementioned Publication No. 10(1998)-5207, the collimator plates 210 have to curved. As a result, the step of inserting the collimator plates 210 along the grooves curved over an even longer length becomes necessary and the fabrication becomes even more difficult.

SUMMARY OF THE INVENTION

The present invention has been made in view of the aforementioned disadvantages found in the prior art. Accordingly, the primary object of the invention is to provide an X-ray scatter reducing grid which can be reliably and easily fabricated with a high degree of accuracy.

To achieve this end, there is provided a self-supporting grid comprising:

a plurality of radiation-absorbing plates disposed in parallel at predetermined intervals over an entire area to which radiation is exposed, each radiation-absorbing plate consisting of a radiation-absorbing substance and having width in a direction in which the radiation travels; and at least two support members for supporting the opposite end portions of each of the radiation-absorbing plates;

wherein the support members are provided with plate-receiving means which receives the plurality of radiation-absorbing plates, the radiation-absorbing plates being inserted in the plate-receiving means and being supported by the support members.

The expression "the radiation-absorbing plates are inserted in the plate-receiving means and are supported by the support members" includes fixing the radiation-absorbing plates by firm attaching means, such as adhesion, fusing and the like, as well as supporting the radiation-absorbing plates by friction.

In the X-ray scatter reducing grid according to the present invention, the radiation-absorbing plates do not need to be inserted over a long distance, because the radiation-absorbing plates are inserted and supported at the opposite ends thereof with respect to the two support members. In addition, there is only a slight possibility that the radiation-absorbing plates will bend during insertion, since the frictional resistance at the time of insertion is low. Thus, the X-ray scatter reducing grid can be fabricated reliably and easily with a high degree of accuracy.

The plate-receiving means provided in the support member can be constructed by a plurality of grooves which receive and support the opposite edges of the radiation-absorbing plate, or by a plurality of slots which receive and support the opposite end portions of the radiation-absorbing plate, or by a plurality of elongated holes which receive and support the opposite end portions of the radiation-absorbing plate. In the case where the plate-receiving means is constructed by the grooves, the structural strength of the support members can be kept because there is no slot in the support members. In the case where the plate-receiving means is constructed by the slots, the structural strength of the grid after fabrication can be increased because the radiation-absorbing plates are firmly supported by the support members. In the case where the plate-receiving means is constructed by the elongated holes, vertical positioning can be performed even more accurately, because there is no possibility that the radiation-absorbing plates will shift vertically, i.e., in the direction perpendicular to the longitudinal direction of the support members, after the insertion of the radiation-absorbing plates into the elongated holes.

The radiation-absorbing plates may be pulled so that they are stretched in the longitudinal direction of the radiation-absorbing plates and may be fixed to the support members under the pulled condition. Even if deflection occurs in the radiation-absorbing plates, in the case where the radiation-absorbing plates are stretched in the longitudinal direction and fixed to the support members and/or the ceiling plate (or the bottom plate), focusing accuracy is enhanced because the deflection can be reduced.

The X-ray scatter reducing grid may further include a ceiling plate and/or a bottom plate, and the radiation-absorbing plates may be fixed to at least one among the plate-receiving means, the ceiling plate, and the bottom plate.

In the X-ray scatter reducing grid, the support members may be constructed by two first support members which support the opposite end portions of each of the radiation-absorbing plates and two second support members which connect to the two first support members so that the four support members constitute a rectangular frame. In such a case, the rigidity of the support members increases the radiation-absorbing plates are easily positioned with accuracy and the structural strength of the grid can be made greater.

The plate-receiving means can be provided so that it extends in a direction converging toward a radiation source being operated. More specifically, a focusing grid with a higher transmittance can be constructed by inserting the radiation-absorbing plates into the plate-receiving means provided so as to incline in the direction that focuses toward the radiation source. In the case where support members (plates) consisting of a radiation-absorbing substance incline in the direction which focuses toward the radiation source, the transmittance of the radiation, which is transmitted through a subject from the radiation source and travels substantially linearly, becomes high. Since cutoff in the circumferential portion of the X-ray scatter reducing grid is eliminated, a variation in the transmittance radiation in a transmitted image is eliminated and high image quality is obtainable. Similarly, in the case where the radiation-absorbing plates are inclined in the directions that focuses toward the radiation source by inserting the plates into the plate-receiving means provided so as to incline in the direction that focuses toward the radiation source, a variation in the transmitted-radiation amount is eliminated and high image quality is obtainable.

In addition to the support members, a plurality of radiation-absorbing support members, which are perpendicular to the radiation-absorbing plates and consist of a radiation-absorbing substance, may be provided over an entire area, to which radiation is exposed, in a direction parallel to the support members. In this case the radiation-absorbing plates and the radiation-absorbing support members form a cross grid as a whole. In such a case, even higher image quality is obtainable over the entire transmitted image.

Furthermore, in the case where slots are formed in both the support members and the radiation-absorbing plates, the grid has advantages in that resistance to insertion can be further reduced, fabrication becomes easy, and mutual positioning is performed with reliability.

Elastic bodies may be interposed between the two support members so that the two support members are urged in a direction in which the radiation-absorbing plates are stretched. The elastic bodies are intended to mean spring material. For example, a compression coil spring can be employed. In this case, flatness in the radiation-absorbing plates is always maintained, because the radiation-absorbing plates are kept stretched.

In accordance with the present invention, there is provided a method of fabricating an X-ray scatter reducing grid, comprising the steps of:

inserting a plurality of radiation-absorbing plates into plate-receiving means formed in at least two support members, the radiation-absorbing plates being disposed in parallel at predetermined intervals over an entire area to which radiation is exposed, and each radiation-absorbing plate consisting of a radiation-absorbing substance and having width in a direction in which the radiation travels; and supporting the opposite end portions of each of the radiation-absorbing plates by the plate-receiving means and thereby constituting the X-ray scatter reducing grid.

In the fabrication method according to the present invention, the radiation-absorbing plates do not need to be inserted over a long distance, because the radiation-absorbing plates are inserted and supported at the opposite ends thereof with respect to the two support members. In addition, there is a little possibility that the radiation-absorbing plates will bend during insertion, since the frictional resistance at the insertion is low. Thus, the X-ray scatter reducing grid can be fabricated reliably and easily with a high degree of accuracy.

In the method, it is preferable that the radiation-absorbing plates be fixed to-the plate-receiving means. Also, the X-ray scatter reducing grid may include a ceiling plate and/or a bottom plate. It is preferable that the radiation-absorbing plates be fixed to at least one among the plate-receiving means, the ceiling plate, and the bottom plate. In addition, it is preferable that the radiation-absorbing plates be fixed to the support member under the condition in which the radiation-absorbing plates are pulled in the longitudinal direction of the radiation-absorbing plates. Furthermore, the X-ray scatter reducing grid may include support members, which have the plate-receiving means, a ceiling plate, and/or a bottom plate, and the support members may be removed after the radiation-absorbing plates have been fixed to either the ceiling plate or the bottom plate, or both of them. In the case where the support members are removed after the radiation-absorbing plates have been fixed, the grid can be reduced in size and becomes easy to handle, because the number of components can be reduced.

At the positions where the radiation-absorbing plates are supported by the support members, the radiation-absorbing plates may be provided with a second set of slots (plate-receiving means) which engage a first set of slots (plate-receiving means) provided in the support members, and an X-ray scatter reducing grid may be constructed by the engagement between the first and second sets of slots. In this case, if the height of the support members is made the same as that of the radiation-absorbing plates, and if each slot is formed by approximately half of the height of the support members or the radiation-absorbing plates, the upper and lower ends of the plates become substantially coplanar with those of the support members when they are assembled. As a result, the grid is capable of having a well-ordered configuration as a whole.

The opposite end portions of the radiation-absorbing plate may be formed with holes and stretched in the opposite directions by metal wires, or rods, passed through the holes. Also, the opposite end portions of the radiation-absorbing plate may be provided with cutouts and stretched in the opposite directions by metal wires or the like wound around the cutouts. In these cases, the other end of the metal wire or the rod may be fixed to a jig disposed to surround the circumference of the X-ray scatter reducing grid, and a stretch in the radiation-absorbing plate may be temporarily maintained until the radiation-absorbing plate is fixed to the support members and/or the ceiling plate (or the bottom plate). Furthermore, the opposite end portions of the radiation-absorbing plate may be clamped by a tool such as cutting pliers and stretched in the opposite directions.

The above and many other objects, features and advantages of the present invention will become manifest to those skilled in the art upon making reference to the following detailed description and accompanying drawings in which preferred embodiments incorporating the principle of the present invention are shown by way of illustrative example.

DESCRIPTION OF THE PREFERRED EMBODIMENTS

Preferred embodiments of the present invention will hereinafter be described in detail with reference to the drawings. Note that in FIGS. 1 to 16, the thickness of each component, the width of each slot, the number of radiation-absorbing plates, the ratio of the dimensions of each component, etc., do not always agree with reality.

Figure 1A:
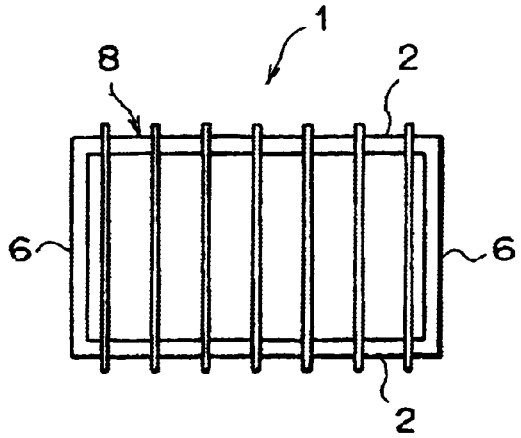
FIG. 1A is a plan view showing an X-ray scatter reducing grid constructed according to a first embodiment of the present invention.
Figure 1C:
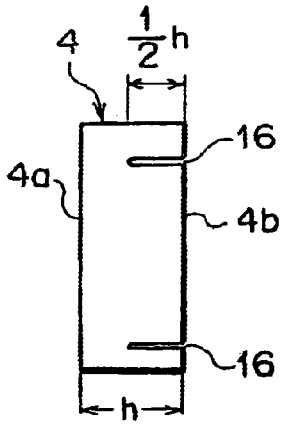
FIG. 1C is aside view of the radiation-absorbing plate used in the grid of FIG. 1A.

Referring to FIG. 1, there is shown an x-ray scatter reducing grid (hereinafter referred simply to as a grid) 1 in accordance with a first embodiment of the present invention. The grid 1 has support members (first support members) 2, 2 consisting of radiation-transmitting material (radiation non-absorbing material) such as wood, aluminum and the like. The support members 2 are formed thick and connected at the opposite ends of each member to two connecting members (second support members) 6. That is, the support members 2 and the connecting members 6 as a whole constitute a rectangular frame 8,thereby giving rigidity to the grid 1. The connecting members 6 and the support members 2 may be coupled by means of adhesion, or they may be formed integrally with one another. While this first embodiment is provided with the connecting members 6, structure without the connecting members 6 is also possible. Similarly, in other embodiments to be described later, structure without the connecting members 6 is possible. The grid 1 further has radiation-absorbing plates 4. Each radiation-absorbing plate 4 consists of a plate containing a substance, which absorbs radiation relatively well, such as lead, tantalum, tungsten and the like. Note that in other embodiments to be described later, radiation-absorbing plates also consist of the same material.

Figure 1B:
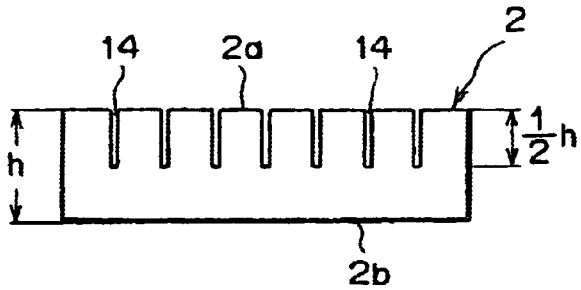
FIG. 1B is a front view of the support member used in the grid of FIG. 1A.

In the support members 2 of the first embodiment, from the upper edge 2*a* thereof toward the lower edge 2*b* a plurality of plate-receiving means (in this embodiment, slots 14) are formed in parallel at predetermined intervals at approximately half (½ h) of the height h of the support member 2, as shown in FIG. 1B. The slots 14 extend in a direction going substantially toward the side of a radiation source (not shown), i.e., in a direction perpendicular to the paper surface of FIG. 1A. On the other hand, the radiation-absorbing plate 4 is formed with two parallel slots 16 (which extend in the direction opposite from the slots 14 of the support member 2), at positions corresponding to the two opposite support members 2, i.e., positions crossing the opposite support members 2 perpendicularly. That is, each slot 16 of the radiation-absorbing plate 4 is formed from the lower edge 4*b* thereof toward the upper edge 4*a* at approximately half (½ h) of the height h of the radiation-absorbing plate 4.

If the slots 16 of the radiation-absorbing plates 4 are positioned with respect to the slots 14 of the support members 2 and engage with the slots 14, a linear grid, i.e., a grid with the radiation-absorbing plates 4 disposed in parallel at predetermined intervals, is constructed as shown in FIG. 1A. In this construction, the radiation-absorbing plates 4 are disposed in parallel to one another and form a parallel grid and are also disposed at right angles to the support members 2. In this way, the support members 2 are capable of supporting and holding the radiation-absorbing plates 4 at predetermined positions.

Since the slots 14 and 16 each have a dimension of half the height h of the respective members, the upper edge 4*a* of the radiation-absorbing plate 4 becomes substantially coplanar with the upper edge 2*a* of the support member 2 after fabrication. The height dimension h of the radiation-absorbing plate 4 is, for example, 1 to 3 cm, while the thickness is 0.1 mm. In addition, the spacing between adjacent slots 14 of the support member 2, i.e., the intervals at which the radiation-absorbing plates 4 are disposed, is approximately 1 mm.

In fabricating the radiation-absorbing plates 4 and the support members 2, the radiation-absorbing plates 4 are inserted in the support members 2 through the respective lower edges 16 and upper edges 14. In this case, the height h of the support member 2 is short compared with the longitudinal direction thereof, and consequently, the resistance during the insertion becomes low. Furthermore, the insertion up to half of the height h is very easy because the resistance between the slot 16 of the radiation-absorbing plate 4 and the slot 14 of the support member 2 is much lower. The same may be said of the following embodiments in which the slot length is approximately half of the height h. Of course, the same is also true of the case where the length of one slot is one-third of h and the other slot length is two-thirds of h. After fabrication, the radiation-absorbing plates 4 and the support members 2 support one another without having solid matter as a member intervening between adjacent radiation-absorbing plates 4, and consequently, the radiation-absorbing plates 4 and the support members 2, as they are, can hold the fabricated form and result in a so-called self-supporting grid. The fixation between the radiation-absorbing plates 4 and the support members 2 may remain inserted, or the fixation may be reinforced by an adhesive agent, fusing, etc. Reinforcing the structure by an adhesive agent, fusing or the like is likewise possible for other embodiments that are to be described later.

Figure 2A:
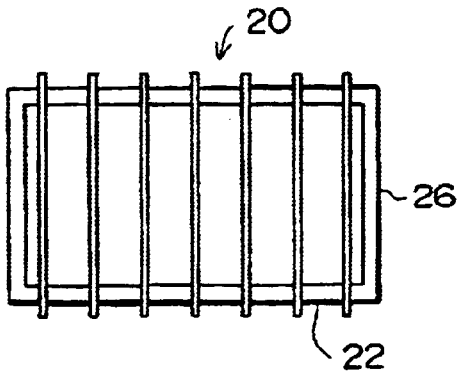
FIG. 2A is a plan view showing an X-ray scatter reducing grid constructed according to a second embodiment of the present invention.
Figure 2C:
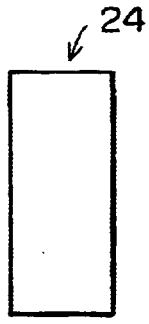
FIG. 2C is a side view of the radiation-absorbing plate used in the grid of FIG. 2A.
Figure 2B:
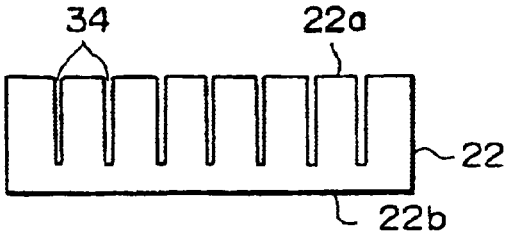
FIG. 2B is a front view of the support member used in the grid of FIG. 2A.
Figure 3:
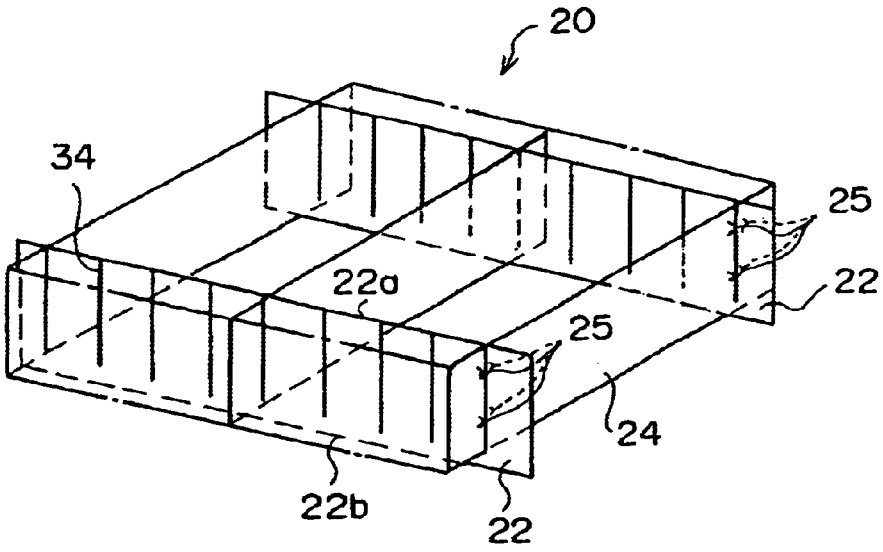
FIG. 3 is a perspective view of the X-ray scatter reducing grid constructed according to the second embodiment of the present invention.

FIGS. 2 and 3 show a grid 20 similar to the grid 1 of the first embodiment, constructed according to a second embodiment of the present invention. Notice that in FIG. 3, the thickness of each component and the connecting members 26 shown in FIG. 2 are omitted for a clear understanding of the present invention.

As illustrated in FIGS. 2 and 3, the essential difference between the grid 20 of the second embodiment and the grid 1 of the first embodiment is that a radiation-absorbing plate 24 has no slot and the slots 34 of a support member 22 extend from its upper edge 22*a* to the vicinity of its lower edge 22*b*.

The manufacture of the radiation-absorbing plate 24 is easy because it has no slot. When fabricating the grid 20, all that is required is to insert the radiation-absorbing plates 24 into the slots 34 of the support members 22. As the slots 34 of the two support members 22 are aligned with one another and formed in parallel, the radiation-absorbing plates 24 are disposed in parallel and constitute a parallel grid, as with the first embodiment. In FIGS. 2 and 3, although the number of radiation-absorbing plates 24 is omitted for convenience, a large number of radiation-absorbing plates 24 are actually disposed in the slots 34 of the support members 22. It is preferable that the radiation-absorbing plates 24 be bonded to the slots 34 of the support members 22 so that the plates 24 do not to move within the slots 34. Alternatively, protrusions (FIG. 3) may be formed on the radiation-absorbing plate 24 to interpose the support member 22 therebetween in order to prevent positional misalignment. In this case, the fixation between the protrusions 25 and the support member 22 can also be reinforced by adhesion.

Figure 4A:
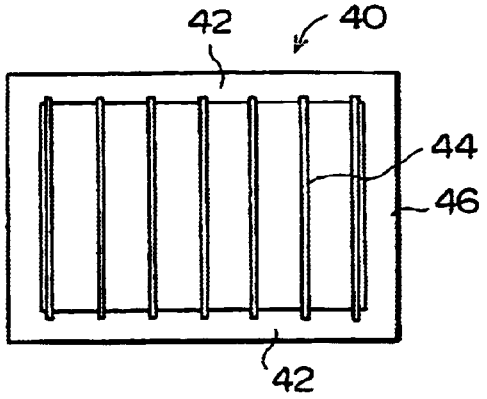
FIG. 4A is a plan view showing an X-ray scatter reducing grid constructed according to a third embodiment of the present invention.
Figure 4C:
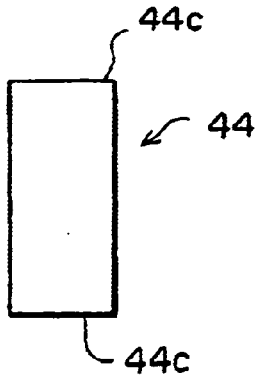
FIG. 4C is a side view of the radiation-absorbing plate used in the grid of FIG. 4A.
Figure 4B:
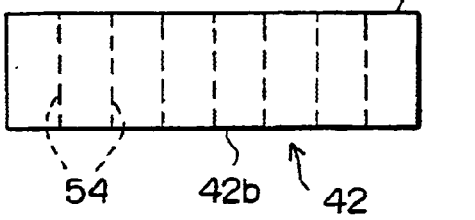
FIG. 4B is a front view of the support member used in the grid of FIG. 4A.
Figure 5:
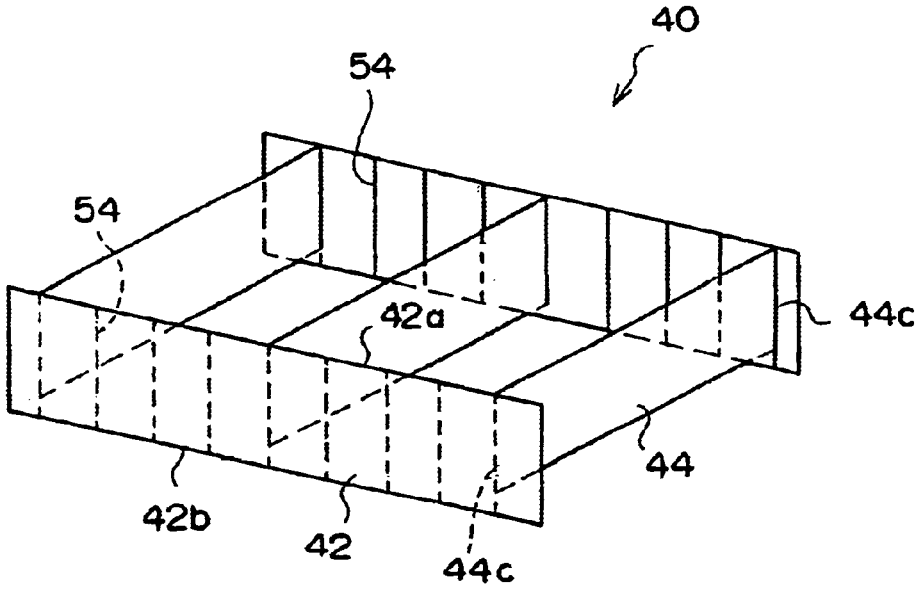
FIG. 5 is a perspective view of the X-ray scatter reducing grid constructed according to the third embodiment of the present invention.

FIGS. 4 and 5 show a grid 40 constructed according to a third embodiment of the present invention. In the third embodiment, the plate-receiving means for receiving and supporting radiation-absorbing plates is constructed by grooves 54 formed in support members 42. Note that in FIG. 5, the connecting members 46 shown in FIG. 4 are omitted for a clear understanding of the present invention.

As illustrated in FIGS. 4 and 5, the grid 40 of the third embodiment, as with the aforementioned two embodiments, is a linear grid, but differs in that the plate-receiving means is constructed by the grooves 54 of the support members 42. Radiation-absorbing plates 44 have no slot, as in the second embodiment. In the inner surfaces of the opposite support members 42, a plurality of grooves 54 are formed in parallel from the upper edge 42*a* of the support member 42 to the lower edge 42*b*. Therefore, the opposite edges 44*c* of each radiation-absorbing plate 44 are inserted and supported in the corresponding grooves 54 of the support members 42 through the upper edges 42*a* of the support members 42, and the parallel grid 40 is formed.

The width of the groove 54 of the support member 42 is of such a dimension that the edge 44*c* of the radiation-absorbing plate 44 is press-fitted and supported. However, since the insertion is performed over a short distance, the frictional resistance at the time of insertion is low even if the groove 54 is not formed wide, and there is only a slight possibility that the radiation-absorbing plate 44 will bend.

Because the structure of the radiation-absorbing plate 44 in the third embodiment is also simple, it can be easily manufactured and is inexpensive. In addition, as the groove 54 is formed over the overall length from the upper edge 42*a* of the support member 42 to the lower edge 42*b*, the two support members 42 can be made the same. In the third embodiment, the support member 42 is very strong because the groove 54 is not an opening penetrating the plate thickness of the support member 42. Therefore, the rigidity of the grid 40 is significantly increased and positioning accuracy of the radiation-absorbing plate 44 is enhanced.

Figure 6:
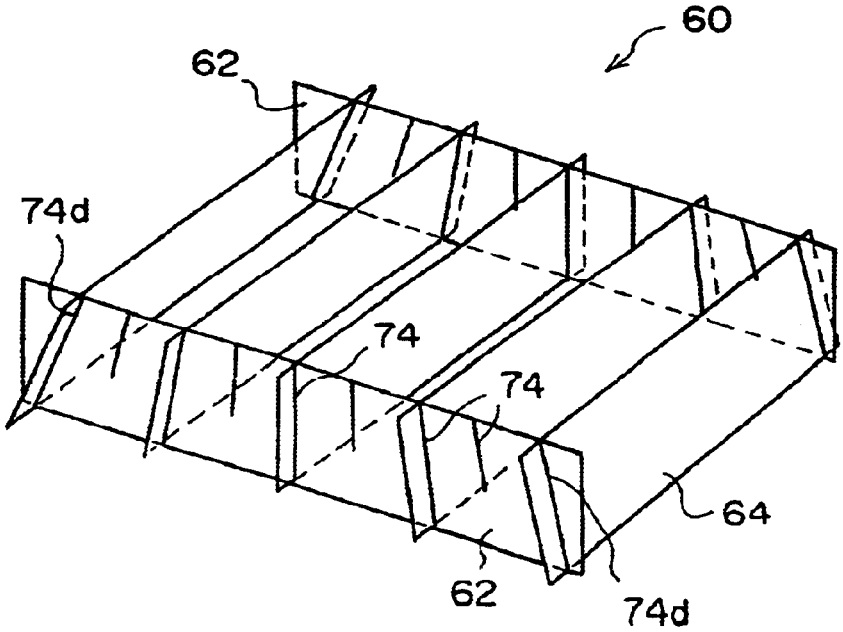
FIG. 6 is a perspective view of an X-ray scatter reducing grid constructed according to a fourth embodiment of the present invention.
Figure 7A:
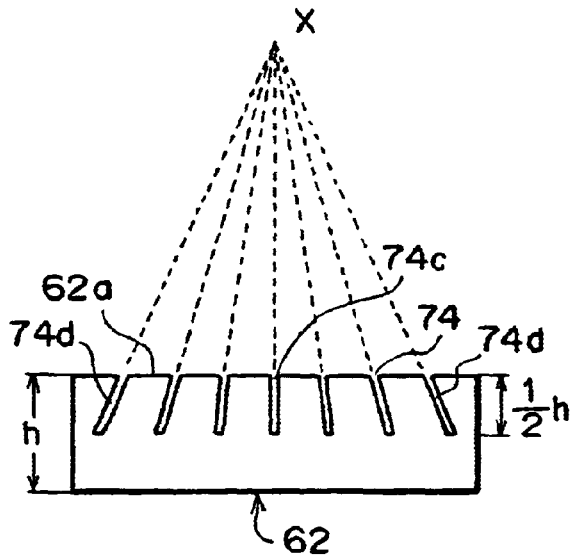
FIG. 7A is a front view of the support member used in the grid of FIG. 6.
Figure 7B:
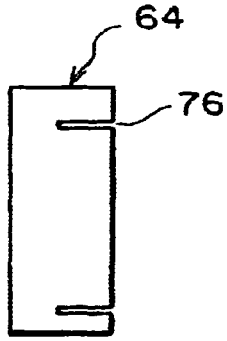
FIG. 7B is a side view of the radiation-absorbing plate used in the grid of FIG. 6.
Figure 8A:
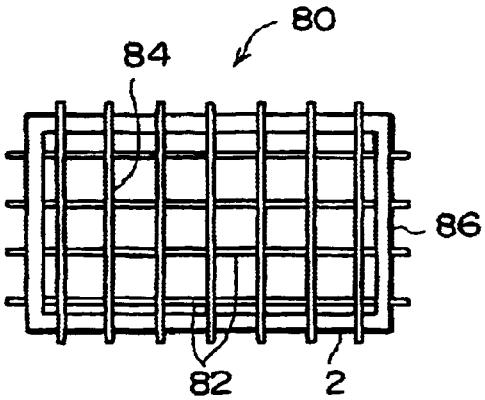
FIG. 8A is a plan view showing an X-ray scatter reducing grid constructed according to a fifth embodiment of the present invention.
Figure 8D:
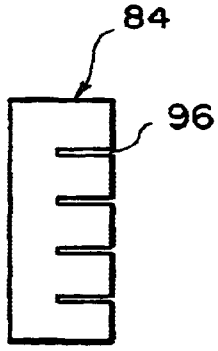
FIG. 8D is a side view of the radiation-absorbing plate used in the grid of FIG. 8A.
Figure 8B:
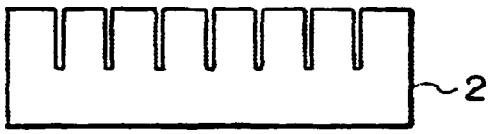
FIG. 8B is a front view of the support member used in the grid of FIG. 8A.
Figure 8C:
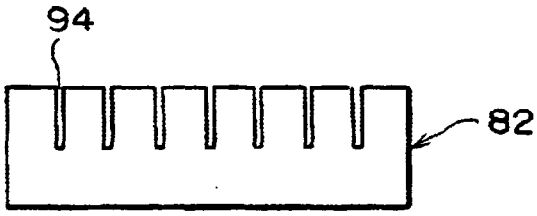
FIG. 8C is a front view of another thin support member used in the grid of FIG. 8A.

FIGS. 6 and 7 show a grid 60 constructed according to a fourth embodiment of the present invention. This fourth embodiment, as with the aforementioned embodiments, is a linear grid, but is different in that a focusing grid in which radiation-absorbing plates 64 incline toward a radiation source X (FIG. 7) is located at a predetermined position. As illustrated in FIGS. 6 and 7A, the plate-receiving means in the fourth embodiment is constructed by a plurality of slots 74, which extend by approximately half of the height h of a support member 62 in the directions that focus toward the radiation source X. Note that some of the slots 74 shown in FIGS. 6 and 7 are omitted in order to make understanding of the present invention easy, but there are actually a large number of slots 74. Since the radiation source X is usually positioned above the central portion of the grid 60, the opposite slots 74*d* of the support member 62 incline most so that they are directed toward the radiation source X. As shown in FIG. 7A, the slots 74 inside the opposite slots 74*d* gradually sequentially approach a right angle with respect to the upper edge 62*a* of the support member 62, and only the central slot 74*c* crosses the upper edge 62*a* at a right angle.

The radiation-absorbing plate 64 has two slots 76 similar to those of the radiation-absorbing plate 4 of the first embodiment shown in FIG. 1. If the support members 62 and the radiation-absorbing plates 64 are assembled, the grid 60 is obtained as shown in FIG. 6. Since the radiation-absorbing plates 64 are disposed in the directions that focus at the radiation source X, some of the rays, transmitted through a subject (not shown) positioned between the radiation source X and the grid 60, are linearly incident on the grid 60 without being intercepted by the radiation-absorbing plates 64. These rays then reach a radiation detector (not shown) positioned under the grid 60, and form a transmitted image. As a result, so-called cutoff, which is normally caused by interception of the transmitted radiation performed by the radiation-absorbing plates 64, will not occur, and a variation in the transmittance is eliminated and an image of high image quality is obtained. As with the aforementioned embodiments, the two support members 62 can be made the same.

FIG. 8 shows a cross grid 80 constructed according to a fifth embodiment of the present invention The difference between the grid 80 of the fifth embodiment and the linear grids 1, 20, 40 and 60 of the aforementioned four embodiments is that radiation-absorbing plates 84 are each provided with a plurality of slots 96 disposed in parallel at predetermined intervals. Also, a plurality of thin support members (plates) 82, which are composed of the same material as the radiation-absorbing plate 84, i.e., a radiation-absorbing substance such as lead, tantalum and the like, are disposed in parallel in the slots 96 of the radiation-absorbing plates 84. With this disposition, the radiation-absorbing support members 82 and the radiation-absorbing plates 84 as a whole constitute the cross grid 80. The opposite ends of each radiation-absorbing support member 82 are connected to the opposite connecting members 86 through the opposite slots 96 of the radiation-absorbing support member 84. In addition, since the radiation-absorbing support members 82 and the radiation-absorbing plates 84 engage with one another, the self-supporting grid 80 with great structural strength is obtained.

In cooperation with the radiation-absorbing plates 84, the radiation-absorbing support members 82 in the cross grid 80 absorb more scattered radiation than the linear grid, and consequently, the cross grid 80 achieves high image quality. However, cutoff will occur in the circumferential portion of the grid 80, because the radiation-absorbing support members 82 and the radiation-absorbing plates 84 in the fifth embodiment of FIG. 8 do not incline in the directions that focus at the radiation source X (FIG. 7). For this reason, radiation, transmitted through the subject and traveling linearly, is absorbed to some degree in the circumferential portion of the grid 80, so there is a possibility that the image quality will degrade.

Figure 9:
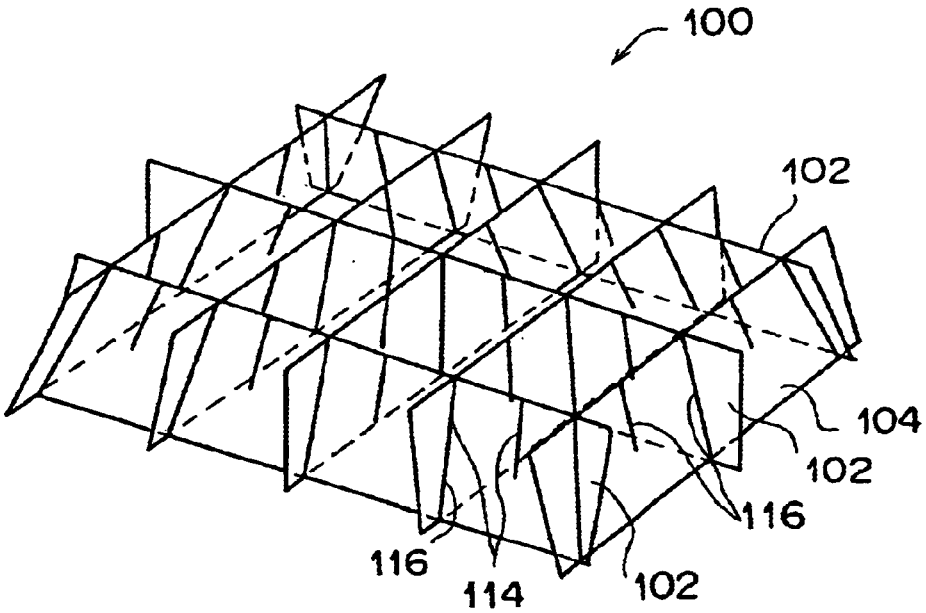
FIG. 9 is a perspective view of an X-ray scatter reducing grid constructed according to a sixth embodiment of the present invention.
Figure 10:
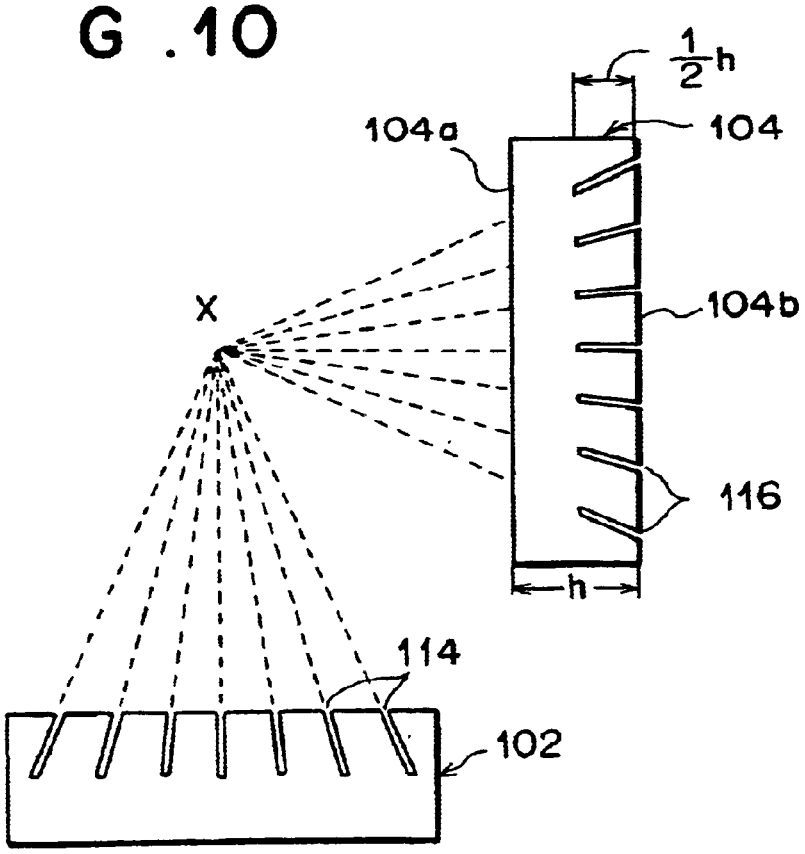
FIG. 10 shows front and side views of the support member and radiation-absorbing plate used in the grid of FIG. 9, along with a radiation source.

A grid 100 of a sixth embodiment improving the above disadvantage is shown in FIGS. 9 and 10. FIG. 10 shows a support member 102 and a radiation-absorbing plate 104 used in the grid 100. In the grid 100 of the sixth embodiment, slots 114 and 116, inclining in the directions that focus at a radiation source X (FIG. 10), are formed in the support member 102 and the radiation-absorbing plate 104, respectively. The slot 116 of the radiation-absorbing plate 104 is formed from one edge 104*b* of the radiation-absorbing plate 104 toward the other edge 104*a* by approximately half of the height h of the radiation-absorbing plate 104. With this construction, the support members 102 and the radiation-absorbing plates 104 engage with one another, whereby the cross grid 100 is formed as shown in FIG. 9. As with the fifth embodiment, it is desirable that the support members 102 intervening between the opposite support members 102 be thin.

The height of the slot 114 of the support member 102 is approximately half of the height h of the support member 102, as in FIG. 7A. Since the intervening support members 102, as with the fifth embodiment, consist of a radiation-absorbing substance, rays scattered at the subject (not shown) are absorbed by the cross grid 100. In addition, the rays, transmitted through the subject and traveling linearly, arrive at a detector (not shown) without being intercepted by the cross grid 100, i.e., without giving rise to cutoff. Therefore, in the cross grid 100 of this sixth embodiment, the transmittance is enhanced and the scattered radiation are effectively reduced. Thus, a high quality transmitted image is obtained over the entire surface of the grid 100.

Figure 11A:
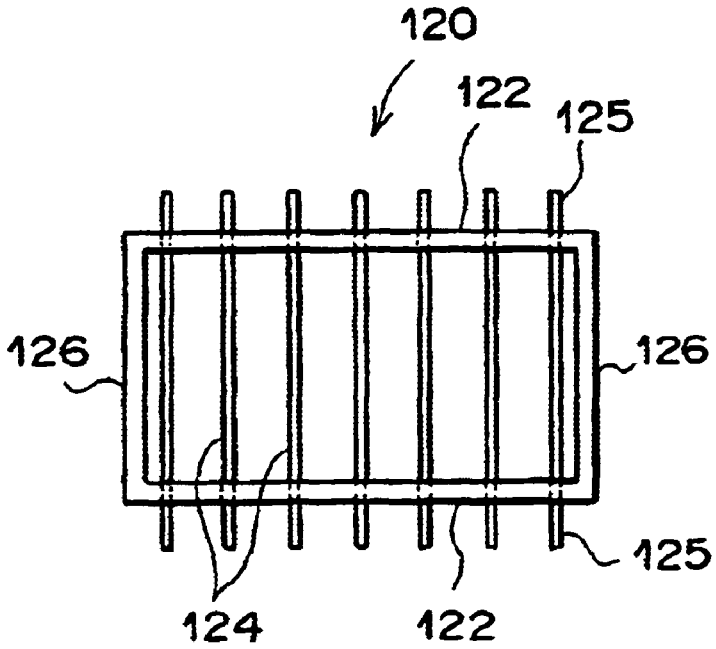
FIG. 11A is a plan view showing an X-ray scatter reducing grid constructed according to a seventh embodiment of the present invention.
Figure 11C:
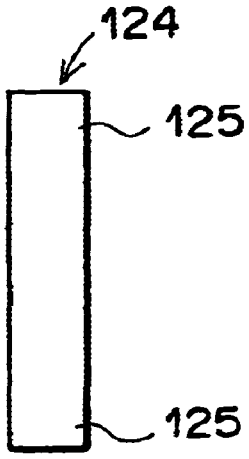
FIG. 11C is a side view of the radiation-absorbing plate used in the grid of FIG. 11A.
Figure 11B:
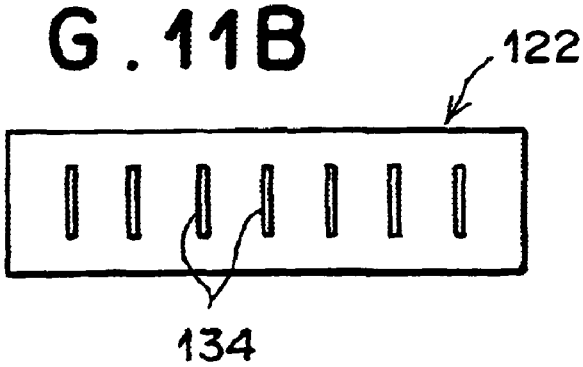
FIG. 11B is a front view of the support member used in the grid of FIG. 11A.

FIG. 11 shows a grid 120 of a seventh embodiment of the present invention. The seventh embodiment differs from the aforementioned embodiments in that the plate-receiving means provided in the support members 122 are constructed by elongated holes 134. The support members 122 are connected at the opposite ends to the connecting members 126 and are formed into the shape of a frame as a whole, as with the first embodiment. In each support member 122, a plurality of vertical elongated holes 134 (i.e., plate-receiving means) are formed at predetermined intervals along the longitudinal direction of the support member 122. Rectangular radiation-absorbing plates 124 are inserted into these elongated holes 134, and the end portions 125 of each radiation-absorbing plate 124 penetrate the elongated holes 134 and project from the holes 134. After the radiation-absorbing plates 124 have been inserted into the elongated holes 134, movement of the radiation-absorbing plates 124 in the vertical direction perpendicular to the longitudinal direction is regulated and therefore there is no possibility that the radiation-absorbing plates 124 will slide in the vertical direction. In this way, the radiation-absorbing plates 124 are supported in parallel by the support members 122, whereby the grid 120 is constructed. In this condition the radiation-absorbing plates 124 may be fixed to the support members 122 by adhesion or the like. However, in the case where there is deformation, such as deflection, wrinkles and the like, in the radiation-absorbing plates 124, there is a need to correct the plate deformation before fixation and make the radiation-absorbing plates 124 flat.

The method of correcting plate deformation will be described with reference to FIG. 12. As shown in FIG. 12A, the end portions of two metal wires 131 are passed through holes 126 formed in the end portions 125 of a radiation-absorbing plate 124*a* and are tied in loop form. Then, the radiation-absorbing plate 124*a* is pulled in the opposite directions by the two metal wires 131, whereby deformation, such as wrinkles and the like, is corrected. This correcting operation is performed after the radiation-absorbing plates 124*a* have been inserted into the support members 122, and the same applies to radiation-absorbing plates 124*b*, 124*c* to be described later. A frame-shaped jig 133 (only the part of which is shown in FIG. 12A) is disposed to surround the circumference of the grid 120, and the other end of the metal wire 131 which stretches each radiation-absorbing plate 124*a* is wound and fixed to this jig 133. Next, the radiation-absorbing plates 124*a* thus stretched are fixed to the support members 122 by adhesion or the like. In addition, instead of the metal wire 131, a rod (not shown) may be inserted into the hole 125 and the other end of this rod fixed to the jig 133 by an appropriate method.

Figures 12A, 12B, 12C:
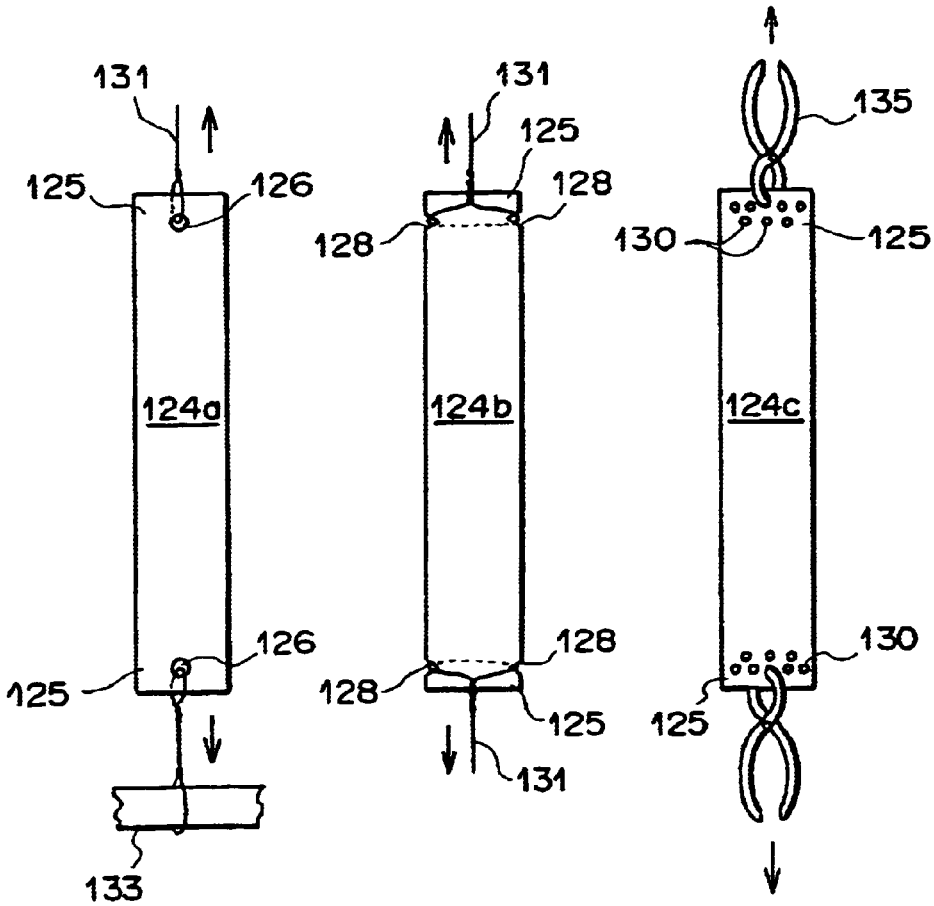
FIG. 12A is a diagram showing an embodiment of the method of stretching the radiation-absorbing plate shown in FIG. 11C.
FIG. 12B is a diagram showing another embodiment of the stretching method.
FIG. 12C is a diagram showing still another embodiment of the stretching method.

In the case of the radiation-absorbing plate 124*b* shown in FIG. 12B, cutouts 128 are formed in the opposite end portions 125 of the radiation-absorbing plate 124*b*, respectively. The end portions of the aforementioned wires 131 are wound around these cutouts 128 and tied in the form of a loop. The operation thereafter is the same as the case of FIG. 12A.

In the case where the metal wires 131 are not used, irregularities 130 on the surfaces of both end portions 125 of the radiation-absorbing plate 124*c* may be clamped by a tool 135 such as cutting pliers and pulled in the opposite directions, as shown in FIG. 12C. The irregularities 130 are formed by embossing and prevent the tool 135 from slipping when clamped by the tool 135. When the tool 135 is not used, the aforementioned jig 133 is not used. In addition, the irregularities 130 may be formed by notching.

Note that while the method of correcting plate deformation has been described in the case of the elongated holes 134, plate deformation can also be corrected for the slots 14, 34 (FIGS. 1 and 2) and the grooves 54 (FIG. 4) in the same manner. For instance, for the slots 14 shown in FIG. 1, the radiation-absorbing plates 4 are inserted into the support members 2, as in the elongated holes 134. After insertion, the end portions of each radiation-absorbing plate 4 protruding from 64 the slots 14 are pulled, and after deformation in each radiation-absorbing plate 4 has been corrected, the radiation-absorbing plates 4 are glued to the support members 2. This method can also be used in the cross grid 80 (FIG. 8) in which the radiation-absorbing support members 82 and the radiation-absorbing plates 84 are disposed in the form of a lattice. In this case, deformation in all the radiation-absorbing support members 82 and radiation-absorbing plates 84 can be corrected by pulling them vertically and horizontally, i.e., in 4 directions. Thereafter, they may likewise be fixed by adhesion.

In the grooves 54 shown in FIG. 4, each radiation-absorbing plate 44 is pulled to a length equal to the space between the support members 42 plus two groove depths, and then the radiation-absorbing plates 44 are connected to the grooves 54 by adhesion. When the radiation-absorbing plate 44 is longer than the aforementioned length, it may be cut to coincide with that length. Thereafter, the radiation-absorbing plates 44 are likewise glued to the support members 42.

Figure 13A:
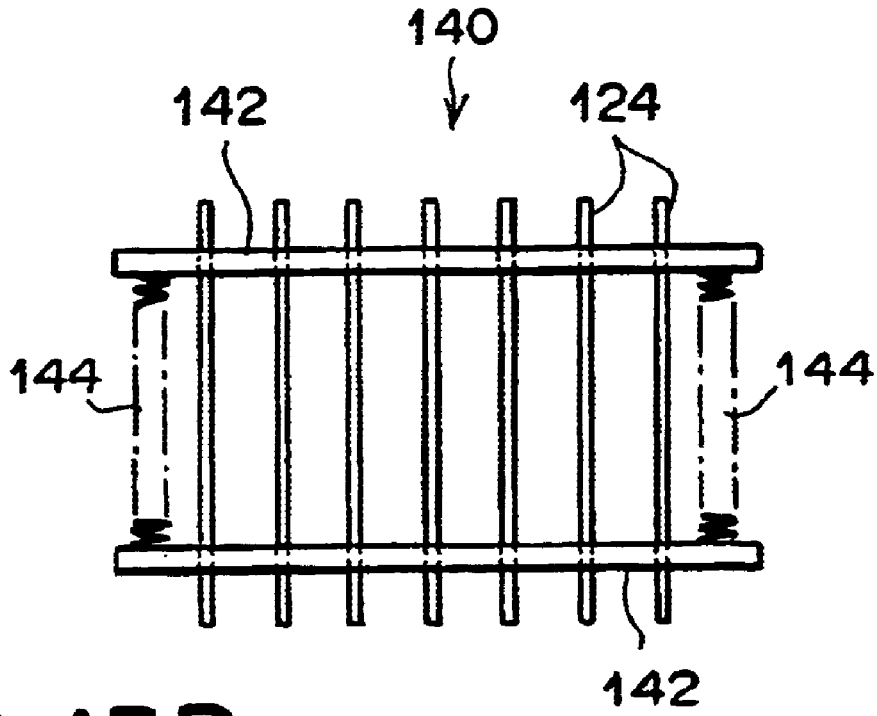
FIG. 13A a plan view showing a grid that is capable of keeping radiation-absorbing plates stretched.

FIG. 13 shows a grid 140 that is capable of keeping radiation-absorbing plates 124 stretched, after the grid has been constructed. Note that a description is made by applying the same reference numerals to the same components. As illustrated in FIG. 13A, two compression coil springs (hereinafter referred to simply as springs) (elastic bodies) 144 are interposed between both end portions of two support members 142 supporting a large number of radiation-absorbing plates 124 in parallel. As the springs 144 pull support members 142 in the opposite directions, the radiation-absorbing plates 124 fixed to the support members 142 are stretched and their flatness is ensured. The springs 144 are inserted onto shafts (not shown) or into a cylindrical member (not shown), whereby the shape is maintained. Instead of the springs 144, other elastic bodies, for example, synthetic resin material with elasticity, such as polyurethane, may be employed.

Figure 13B:
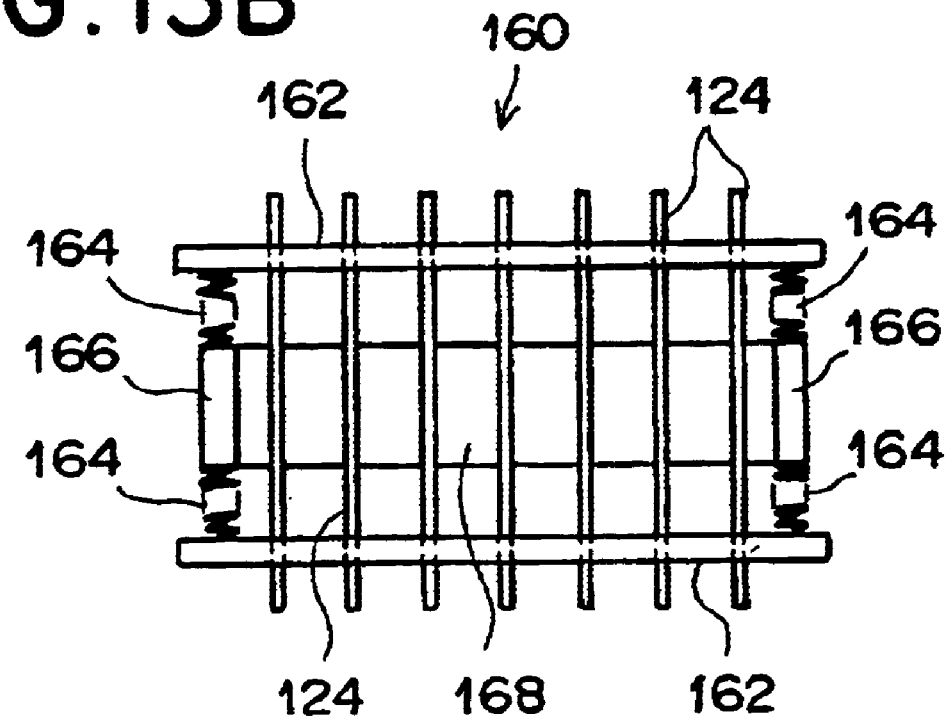
FIG. 13B a plan view showing another grid that is capable of keeping radiation-absorbing plates stretched.

In a grid 160 shown in FIG. 13B, springs 164 for urging support members 162 are provided on both sides of a pair of fixed or unmovable portions 166. The fixed portions 166 are disposed at the opposite end portions of the support members 162 and are coupled with a base 168, which is part of the grid 160, or are formed integrally with the base 168. The fixed portions 166 are disposed approximately midway between the two support members 162. This can make the length of the springs 164 shorter and prevent the springs 164 from being deflected horizontally.

Figure 14:
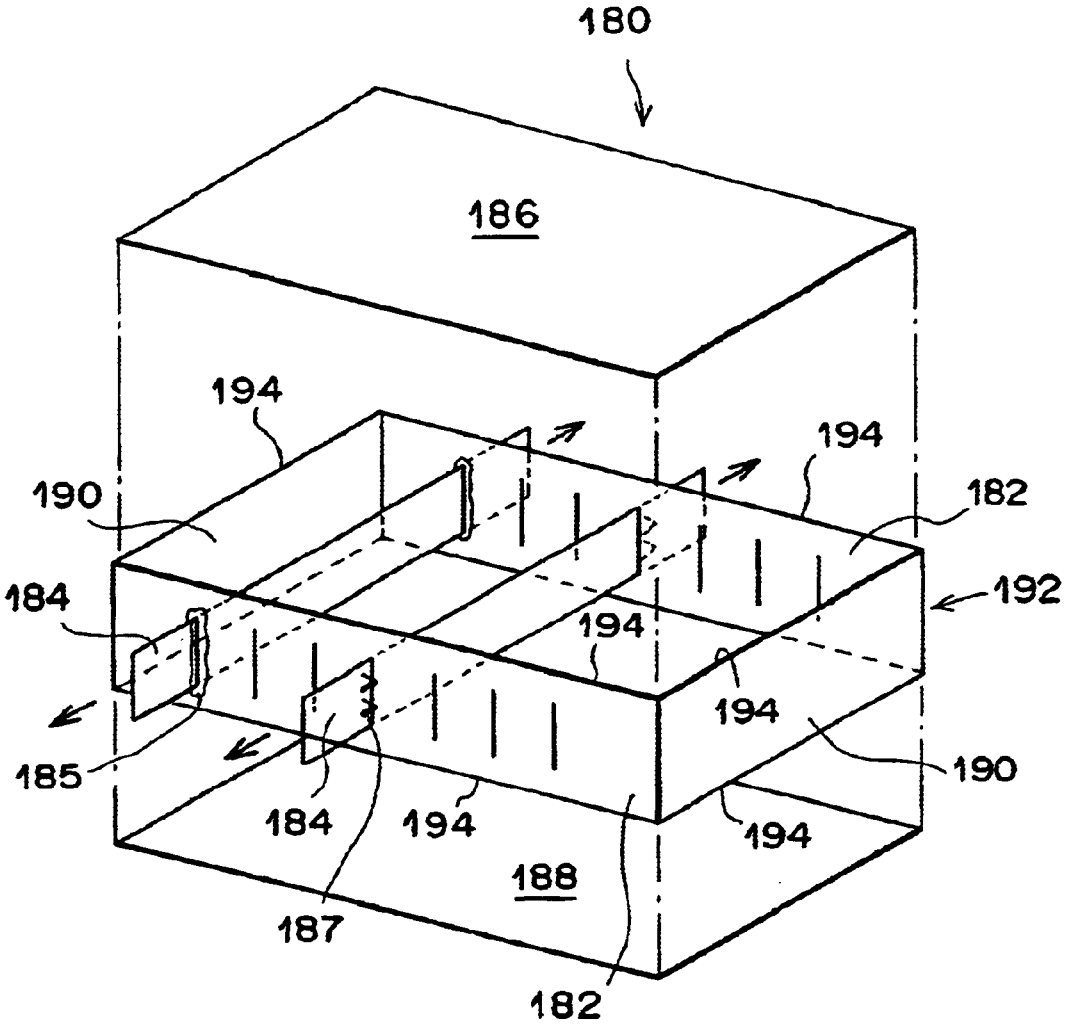
FIG. 14 is a perspective view showing a grid constructed according to an eighth embodiment of the present invention.

FIG. 14 shows a grid 180 that is an eighth embodiment of the present invention, in which stretched radiation-absorbing plates 184 are fixed by use of surface plates consisting of carbon, i.e., a ceiling plate 186 and a bottom plate 188. First, the radiation-absorbing plates 184 are fixed to the support members 182 by an adhesive agent 185, or protrusions 187, etc. Then, the ceiling plate 186 and the bottom plate 188 are disposed to interpose the radiation-absorbing plates 184 therebetween and are glued to the radiation-absorbing plates 184 by adhesion or the like. The ceiling plate 186 and the bottom plate 188 are slightly smaller in outside dimensions than a frame 192, constructed by the support members 182 and connecting members 190. The ceiling plate 186 and the bottom plate 188, therefore, can easily be inserted into the frame 192 and glued to the radiation-absorbing plates 184. In this way, fixing of the radiation-absorbing plates 184 can be performed even more reliably and therefore the rigidity of the entire grid and the structural strength of the frame 192 are enhanced. In this case, the support members 182 with slots are removable, since the ceiling plate 186, the bottom plate 188, and the radiation-absorbing plates 184 are fixed. In addition, in the case where the ceiling plate 186 and the bottom plate 188 are glued and fixed to the circumferential edges 194 of the frame 192 instead of being inserted into the frame 192, the radiation-absorbing plates 184 are not glued to the ceiling plate 186 and the bottom plate 188, but can maintain the entire rigidity. Furthermore, the radiation-absorbing plates 184 can be held in position, as they are protected from external influence.

Figure 15:
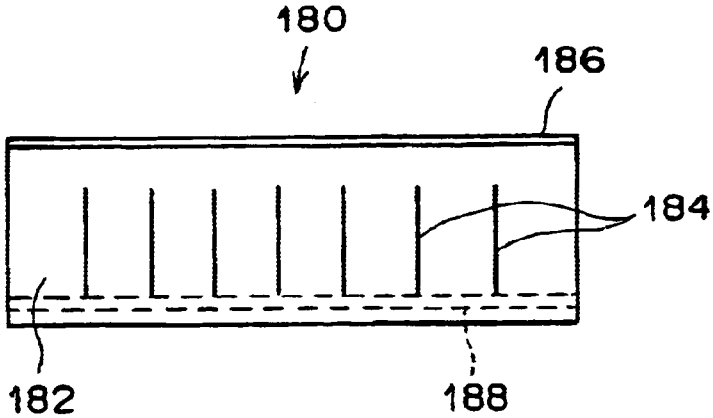
FIG. 15 is a schematic view showing another embodiment of the grid shown in FIG. 14.

In the case of using the ceiling plate 186 and the bottom plate 188 in this manner, the radiation-absorbing plates 184 can be fixed by various methods. For instance, another embodiment of the grid 180 is illustrated in FIG. 15. In the case of this grid 180, the bottom plate 188 is glued to the radiation-absorbing plates 184, while the ceiling plate 186 is glued to the support members 182, i.e., the upper edge of the frame 192. In this case, the bottom plate 188 can also be glued to the frame 192, because it is located inside the frame 192. With this construction, straightness in the radiation-absorbing plates 184 is ensured and the rigidity of the frame 192 can be maintained.

Conversely, the ceiling plate 186 may be inserted into the frame 192 and glued to the radiation-absorbing plates 184, and the bottom plate 188 may be glued to the lower edge 194 of the frame 192, away from the radiation-absorbing plates 184. Similarly, the same effect is obtainable.

In the former case, i.e., in the case where the ceiling plate 186 and the bottom plate 188 are glued to the radiation-absorbing plates 184, grooves may be formed at positions on the inner surfaces of the ceiling plate and bottom plate 186 and 188 which correspond to the radiation-absorbing plates 184. In this case, adhesion and positioning of the radiation-absorbing plates 184 can be performed reliably by inserting the radiation-absorbing plates 184 into the grooves. In addition, in the latter case, i.e., in the case where the ceiling plate 186 and the bottom plate 188 are not glued to the radiation-absorbing plates 184, grooves or stepped portions may likewise be formed at positions on the ceiling plate and bottom plate 186 and 188 which correspond to the support members 182 and the connecting members 190. In this case, positioning of the frame 192 can be formed reliably and these components become difficult to deform.

Figure 16:
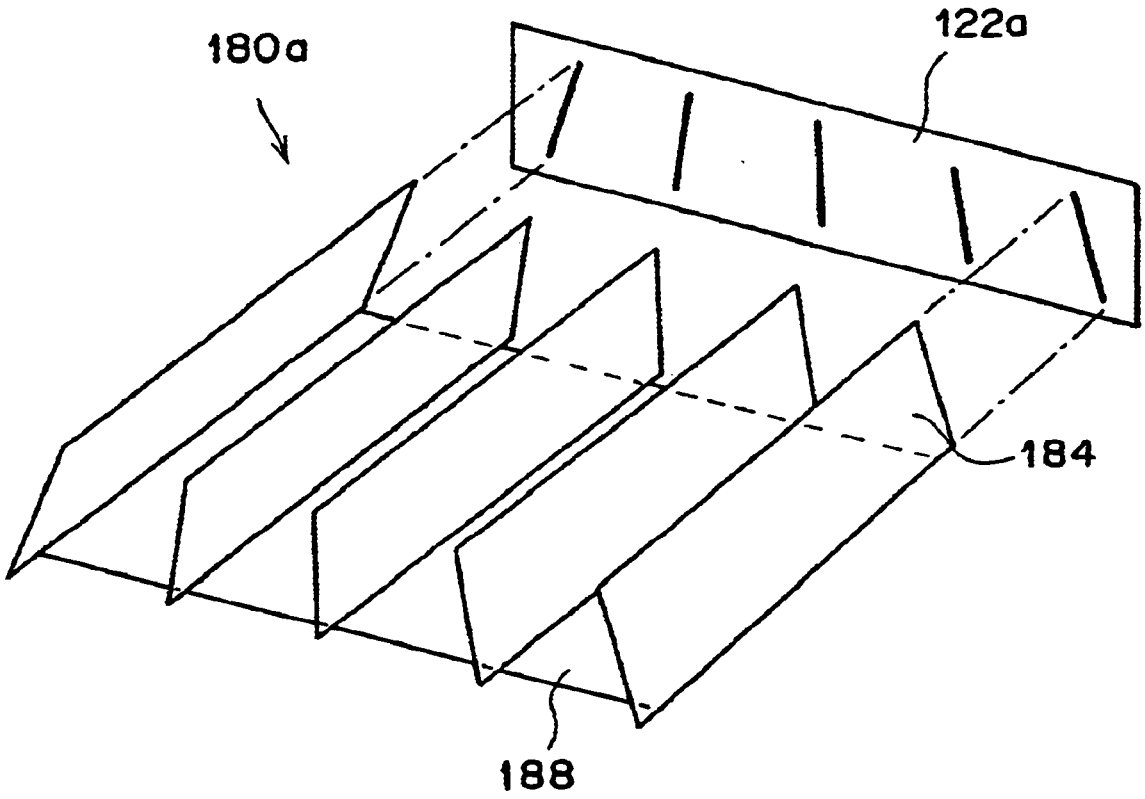
FIG. 16 is a schematic view showing still another embodiment of the grid shown in FIG. 14.
Figure 17A:
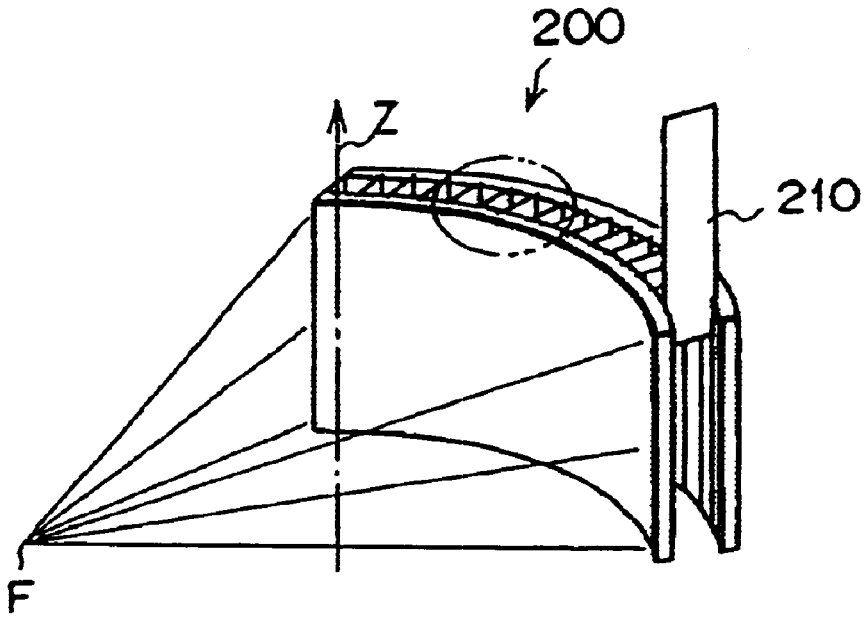
FIG. 17A is a perspective view showing a conventional X-ray scatter reducing grid.
Figure 17B:
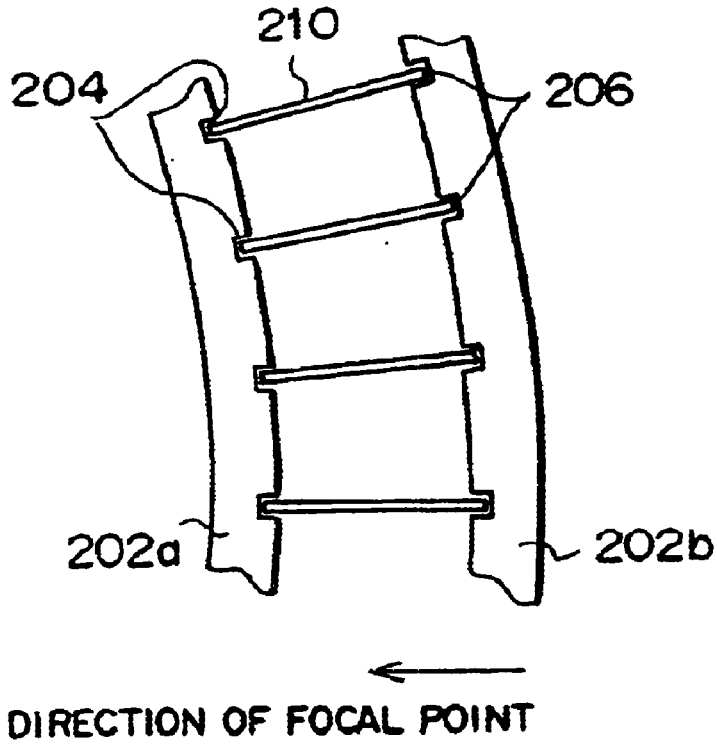
FIG. 17B is an enlarged plan view of the part enclosed by a two-dotted line in FIG. 17A.

Illustrated in FIG. 16 is a grid 180*a* of still another embodiment. Although the radiation-absorbing plates used in this embodiment are the same as the aforementioned radiation-absorbing plates 184, they are mounted on the bottom plate 188 so that they incline toward a source of radiation (not shown). For example, the radiation-absorbing plates 184 are inclined by use of support members 112*a* in which the elongated holes 134 shown in FIG. 11 are arranged to incline toward the radiation source. Then, the inclined radiation-absorbing plates 184 are glued and fixed to the bottom plate 188. Notice that in FIG. 16, only one of the two support members 122*a* is shown. Thereafter, if the support members 122*a* are removed, the grid 180*a* is obtained as shown. In this case, the radiation-absorbing plates 184 are kept inclined by the bottom plate 188 alone, because they are not glued to the ceiling plate 186.

conversely, as another variation, the radiation-absorbing plates 184 may be glued and fixed to the ceiling plate 184, and the bottom plate 188 and the support members 122*a* may be removed.

In the case where the support members 122*a* are finally made unnecessary in this manner, the grid 180*a* can be reduced in size and becomes easy to handle. When the radiation-absorbing plates 184 are great in width, i.e., height, the effect of removing the support member 122*a* becomes much greater because the support members 122*a* becomes greater in height and weight.

While the present invention has been described with reference to the preferred embodiments thereof, the invention is not limited to the details given herein, but may be modified within the scope of the appended claims.

What is claimed is:

1. An X-ray scatter reducing grid comprising:

a plurality of radiation-absorbing plates disposed at predetermined intervals over an entire area exposed to radiation, each radiation-absorbing plate comprising a radiation-absorbing substance and having width in a direction in which said radiation travels; and at least two support members for supporting opposite end portions of each of said radiation-absorbing plates, said support members being provided with plate-receiving means which receive said plurality of radiation-absorbing plates, said radiation-absorbing plates being inserted in said plate-receiving means and being supported by said support members, wherein at least some of said radiation-absorbing plates are pulled so as to be stretched in a longitudinal direction of said radiation-absorbing plates, and said radiation-absorbing plates are fixed to said support members.

2. The X-ray scatter reducing grid as set forth in claim 1, wherein said support members are constructed by two first support members which support the opposite end portions of each of said radiation-absorbing plates and two second support members which connect to said two first support members so that said four support members constitute a rectangular frame.

3. An X-ray scatter reducing grid comprising:

a plurality of radiation-absorbing plates disposed in parallel at predetermined intervals over an entire area exposed to radiation, each radiation-absorbing plate comprising a radiation-absorbing substance and having width in a direction in which said radiation travels; and at least two support members for supporting opposite lengthwise end portions of each of said radiation-absorbing plates, said support members being provided with plate-receiving means which receive said plurality of radiation-absorbing plates, said radiation-absorbing plates being inserted in said plate-receiving means and being supported by said support members, wherein said plate-receiving means are constructed by a plurality of slots which receive and support the opposite lengthwise end portions of each of said radiation-absorbing plates, and wherein at least some of said radiation-absorbing plates are pulled so as to be stretched in a longitudinal direction of said radiation-absorbing plates, and said radiation-absorbing plates are fixed to said support members.

4. An X-ray scatter reducing grid comprising:

a plurality of radiation-absorbing plates disposed in parallel at predetermined intervals over an entire area exposed to radiation, each radiation-absorbing plate comprising a radiation-absorbing substance and having width in a direction in which said radiation travels; and at least two support members for supporting opposite lengthwise end portions of each of said radiation-absorbing plates, said support members being provided with plate-receiving means which receive said plurality of radiation-absorbing plates, said radiation-absorbing plates being inserted in said plate-receiving means and being supported by said support members, wherein said plate-receiving means are constructed by a plurality of elongated holes which receive and support the opposite lengthwise end portions of each of said radiation-absorbing plates, and wherein at least some of said radiation-absorbing plates are pulled so as to be stretched in a longitudinal direction of said radiation-absorbing plates, and said radiation-absorbing plates are fixed to said support members.

5. An X-ray scatter reducing grid comprising:

a plurality of radiation-absorbing plates disposed at predetermined intervals over an entire area exposed to radiation, each radiation-absorbing plate comprising a radiation-absorbing substance and having width in a direction in which said radiation travels; and at least two support members for supporting opposite lengthwise end portions of each of said radiation-absorbing plates, said support members being provided with plate-receiving means which receive said plurality of radiation-absorbing plates, said radiation-absorbing plates being inserted in said plate-receiving means and being supported by said support members, wherein said plate-receiving means is constructed by a plurality of elongated holes which receive and support the opposite end portions of each of said radiation-absorbing plates, and wherein at least some of said radiation-absorbing plates are pulled so as to be stretched in a longitudinal direction of said radiation-absorbing plates, and said radiation-absorbing plates are fixed to said support members.

6. A method of fabricating an X-ray scatter reducing grid, comprising:

inserting lengthwise opposite end portions of each of a plurality of radiation-absorbing plates into plate-receiving means formed in at least two support members, said radiation-absorbing plates being disposed in parallel at predetermined intervals over an entire area to be exposed to radiation, each radiation-absorbing plate comprising a radiation-absorbing substance and having width in a direction in which said radiation travels;

supporting the lengthwise opposite end portions of each of said radiation-absorbing plates by said plate-receiving means;

fixing said radiation-absorbing plates to said plate-receiving means by at least one of adhering, fusing, and press-fitting, pulling at least some of said radiation-absorbing plates so as to stretch pulled ones of said radiation-absorbing plates in a longitudinal direction of said radiation-absorbing plates; and fixing said pulled ones of said radiation-absorbing plates to said support members.

7. A method of fabrication an X-ray scatter reducing grid, comprising:

inserting lengthwise opposite end portions of each of a plurality of radiation-absorbing plates into plate-receiving means formed in at least two support members, said radiation-absorbing plates being disposed in parallel at predetermined intervals over an entire area to be exposed to radiation, each radiation-absorbing plate comprising a radiation-absorbing substance and having width in a direction in which said radiation travels;

supporting the lengthwise opposite end portions of each of said radiation-absorbing plates by said plate-receiving means;

wherein said X-ray scatter reducing grid includes at least one of a ceiling plate and a bottom plate, the method further comprising fixing said radiation-absorbing plates to at least one of said ceiling plate and said bottom plate, pulling at least some of said radiation-absorbing plates so as to stretch pulled ones of said radiation-absorbing plates in a longitudinal direction of said radiation-absorbing plates; and fixing said pulled ones of said radiation-absorbing plates to said support members.

8. An X-ray scatter reducing grid comprising:

a plurality of radiation-absorbing plates disposed in parallel at predetermined intervals over an entire area exposed to radiation, each radiation-absorbing plate comprising a radiation-absorbing substance and having width in a direction in which said radiation travels; and two support members for supporting opposite end portions of each of said radiation-absorbing plates, said support members being provided with plate-receiving means which receive said plurality of radiation-absorbing plates, said radiation-absorbing plates being inserted in said plate-receiving means and being supported by said support members, wherein said radiation-absorbing plates are fixed to said two support member, elastic bodies being interposed between said two support members so that said two support members are urged in a direction in which said radiation-absorbing plates are stretched.

9. The X-ray scatter reducing grid as set forth in claim 8, wherein said support members are constructed by two first support members which support the opposite end portions of each of said radiation-absorbing plates and two second support members which connect to said two first support member so that said four support members constitute a rectangular frame.

10. An X-ray scatter reducing grid comprising:

a plurality of radiation-absorbing plates disposed at predetermined intervals over an entire area exposed to radiation, each radiation-absorbing plate comprising a radiation-absorbing substance and having width in a direction in which said radiation travels; and at least two support members for supporting opposite lengthwise end portions of each of said radiation-absorbing plates, said support members being provided with plate-receiving means which receive said plurality of radiation-absorbing plates, said radiation-absorbing plates being inserted in said plate-receiving means and being supported by said support members, wherein said plate-receiving means is constructed by a plurality of elongated holes which receive and support the opposite end portions of each of said radiation-absorbing plates, and wherein said radiation-absorbing plates are fixed to said two support members, elastic bodies being interposed between said two support members so that said two support members are urged in a direction in which said radiation-absorbing plates are stretched.

* * * * *